US007503805B2

(12) United States Patent
Chang et al.

(10) Patent No.: US 7,503,805 B2
(45) Date of Patent: Mar. 17, 2009

(54) ELECTRICAL CARD CONNECTOR MOUNTED ON PRINTED CIRCUIT BOARD

(75) Inventors: Wei-Cheng Chang, Tu-Cheng (TW); Ming-Lun Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/986,193

(22) Filed: Nov. 20, 2007

(65) Prior Publication Data

US 2008/0119072 A1 May 22, 2008

(30) Foreign Application Priority Data

Nov. 20, 2006 (TW) ..... 95142751 A

(51) Int. Cl.
*H01R 24/00* (2006.01)

(52) U.S. Cl. ..... 439/630; 439/188; 200/51.1

(58) Field of Classification Search ..... 439/630, 439/188, 64, 567; 200/51.1
See application file for complete search history.

(56) References Cited

U.S. PATENT DOCUMENTS 5,470,260 A 11/1995 Schwan
6,132,247 A * 10/2000 Liou et al. ..... 439/567
6,382,995 B1 5/2002 Bricaud et al.
6,392,879 B1 * 5/2002 Chien ..... 361/685
6,641,441 B2 * 11/2003 Liu ..... 439/630
7,063,571 B2 6/2006 Yu
7,234,969 B2 * 6/2007 Chang et al. ..... 439/630
7,320,622 B2 * 1/2008 Ying et al. ..... 439/630
7,357,677 B2 * 4/2008 Liu ..... 439/630
2002/0160661 A1 * 10/2002 Florescu ..... 439/630
2003/0119364 A1 * 6/2003 Liu ..... 439/630
2004/0214474 A1 * 10/2004 Tsai ..... 439/630
2006/0166559 A1 * 7/2006 Nakai et al. ..... 439/630
2007/0293092 A1 * 12/2007 Seo ..... 439/630

* cited by examiner

*Primary Examiner*—T C Patel
*Assistant Examiner*—Harshad C Patel
(74) *Attorney, Agent, or Firm*—Wei Te Chung

(57) ABSTRACT

An electrical card connector (100) mounted on a Printed Circuit Board includes an insulating housing (1), a shell (2) mounted on the insulating housing and a terminal module (3). The insulating housing defines an accommodating room (14), and the shell defines a receiving slot (5) with the insulating housing for a card inserted. The terminal module comprises a plurality of terminals (30) and a position section (32) retained on the PCB. Wherein the terminal module is soldered on the PCB directly, and receiving in the accommodating room of the insulating housing separately.

19 Claims, 4 Drawing Sheets

ELECTRICAL CARD CONNECTOR MOUNTED ON PRINTED CIRCUIT BOARD

BACKGROUND OF THE INVENTION

1. Field of the Invention

The present invention relates to an electrical card connector for accessing an electrical card, and more particularly to an electrical card connector mounted on a Printed Circuit Board (PCB).

2. Description of Prior Arts

An universal electrical card connector is structured by an insulating housing with a plurality of terminals integrally. U.S. Pat. No. 5,470,260, for example, discloses an electrical card connector including an insulating housing, a receiving slot for a card movably received, and a number of terminals protruding into and retained in the receiving slot. The terminals are embedded by the insulating housing, and soldered on the PCB.

However, one problem of the electrical card connector in U.S. Pat. No. 5,470,260 is that the insulating housing is likely to distort during the terminals soldered with high temperature. Therefore, the electrical card connector is degradation, leading to an undesirable signal transmission between the electrical card connector and the PCB.

SUMMARY OF THE INVENTION

An object, therefore, of the invention is to provide an electrical card connector mounted on a PCB, which can avoid an insulating housing distortion.

In the exemplary embodiment of the invention, an electrical card connector mounted on a PCB includes an insulating housing, a shell mounted on the insulating housing and a terminal module. The insulating housing defines an accommodating room, and the shell defines a receiving slot with the insulating housing for a card inserted. The terminal module comprises a plurality of terminals and a position section retained on the PCB. Wherein the terminal module is soldered on the PCB directly, and received in the accommodating room of the insulating housing separately.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
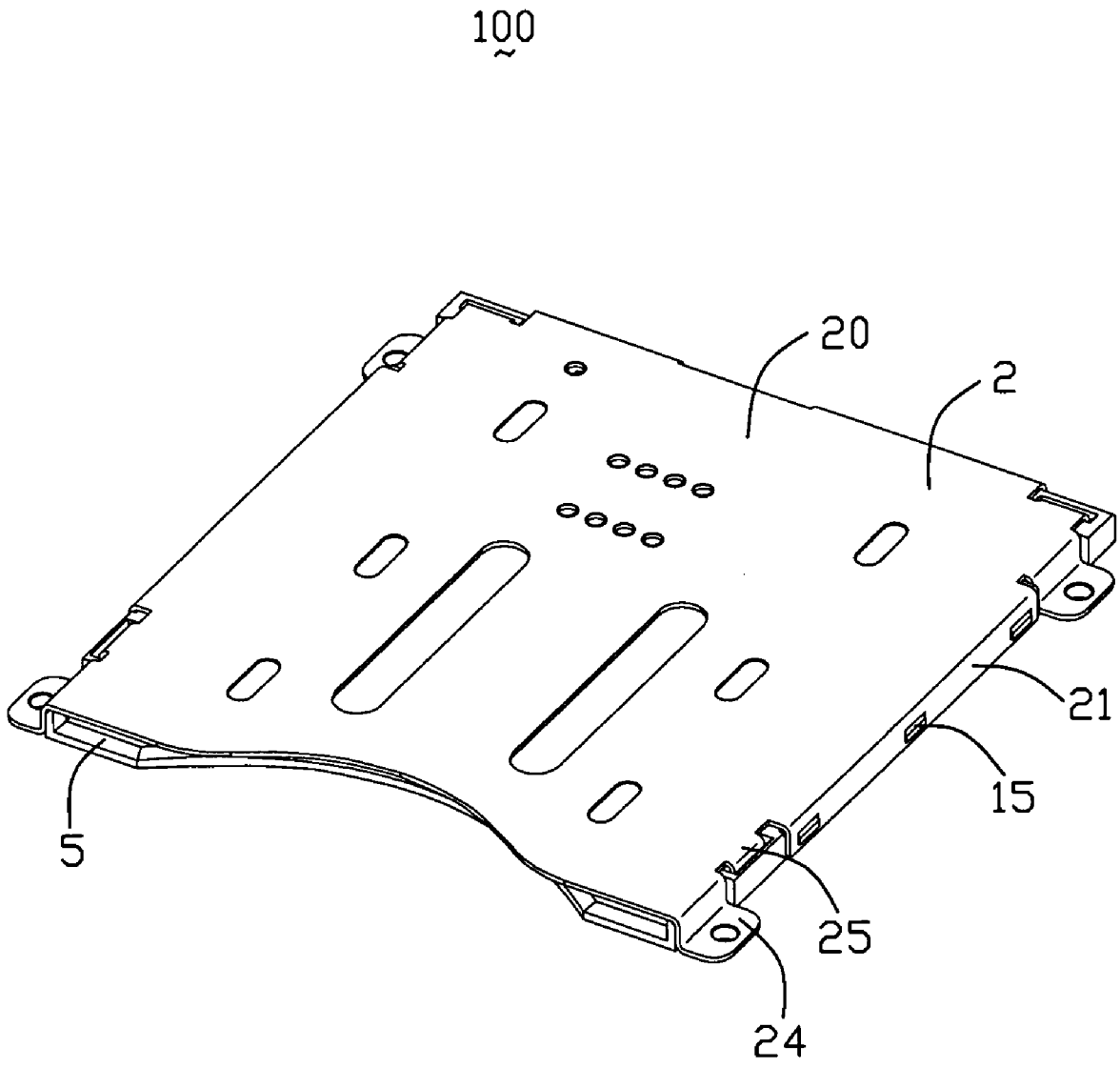
FIG. 1 is a perspective, assembly view of an electrical card connector in accordance with the present invention.
Figure 2:
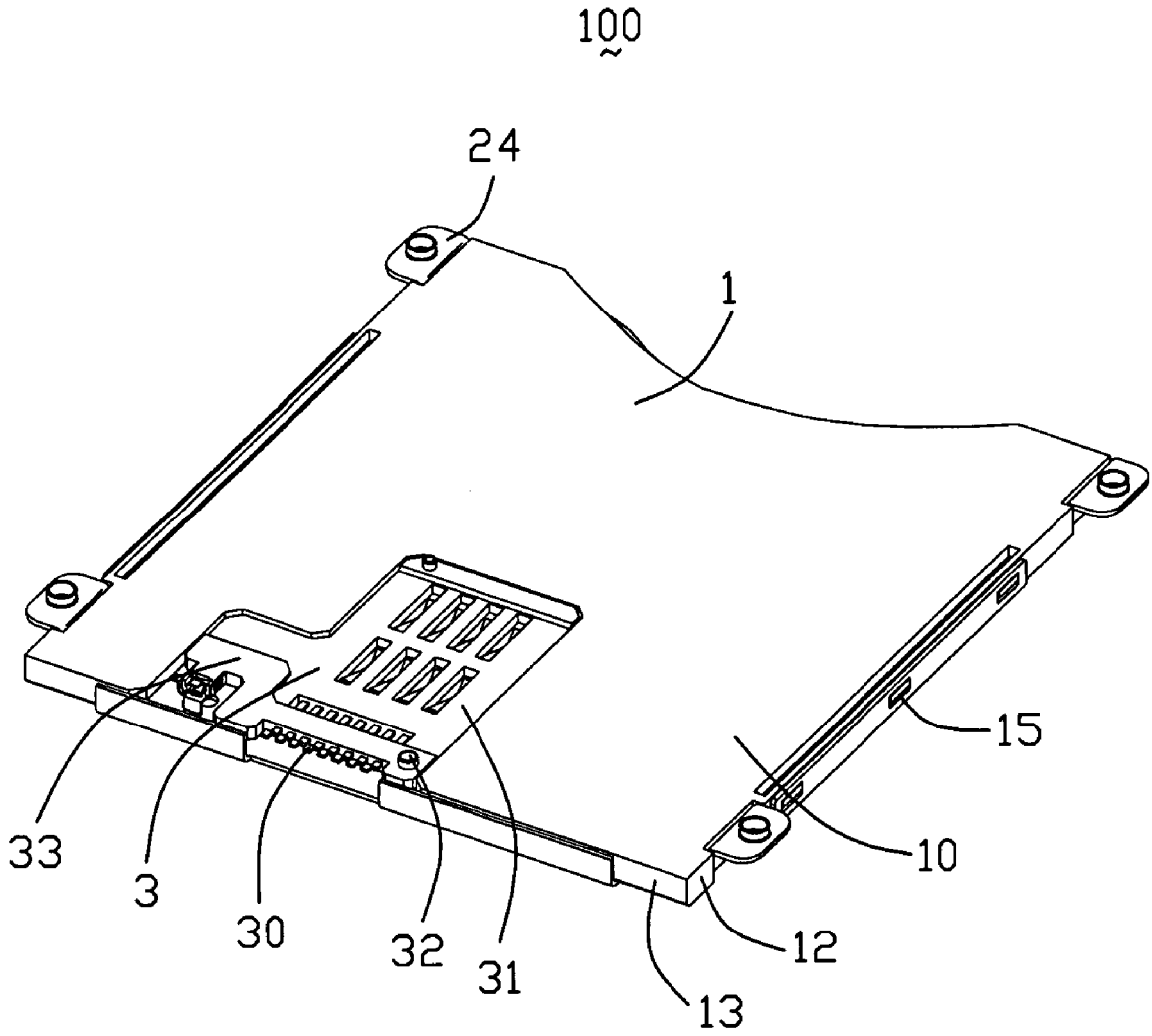
FIG. 2 is similar to FIG. 1, but taken from another aspect.

Referring to FIG. 1 to FIG. 2, a perspective, assembly view of an electrical card connector 100 in accordance with present invention is shown. The electrical card connector 100 has an insulating housing 1, a terminal module 3 receiving a plurality of terminals 30, and a shell 2 mounted on the insulating housing 1 and the terminal module 3.

Figure 3:
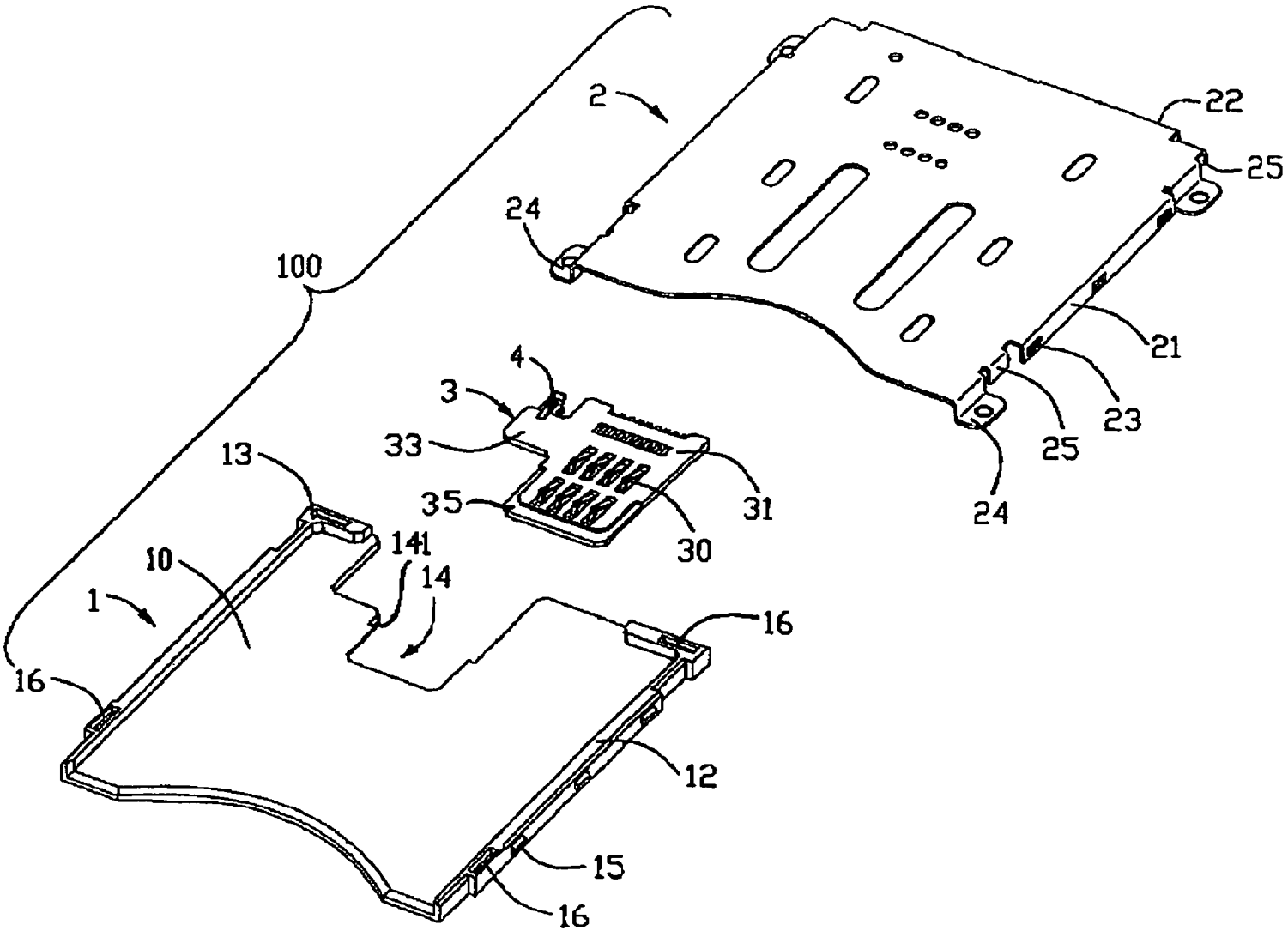
FIG. 3 is an exploded perspective view of the electrical card connector shown in FIG. 1.

As shown in FIG. 3, the insulating housing 1 comprises a panel 10, a pair of lateral parts 12 extending upwardly from the opposite sides of the panel 10 and a tail portion 13 extending upwardly from an end edge of the panel 10. On the panel 10, an accommodating room 14 is defined. The configuration of the accommodating room 14 is accordant with that of the terminal module 3. Each lateral part 12 comprises a plurality of embossments 15 located separately. A plurality of recesses 16 are defined on the lateral parts 12 and the tail portion 13 depressing in an up-to-down direction, respectively.

The shell 2 comprises a body plate 20, a pair of lateral walls 21 extending downwardly from the opposite sides of the body plate 20, and a back wall 22 extending from the body plate 20 between the lateral walls 21. Each lateral wall 21 has a plurality of holes 23 corresponding to the embossments 15 and a plurality of position foots 24 tending horizontally from the low edge of the lateral walls 21. A plurality of fasteners 25 extend downwardly from the body plate 20.

Figure 4:
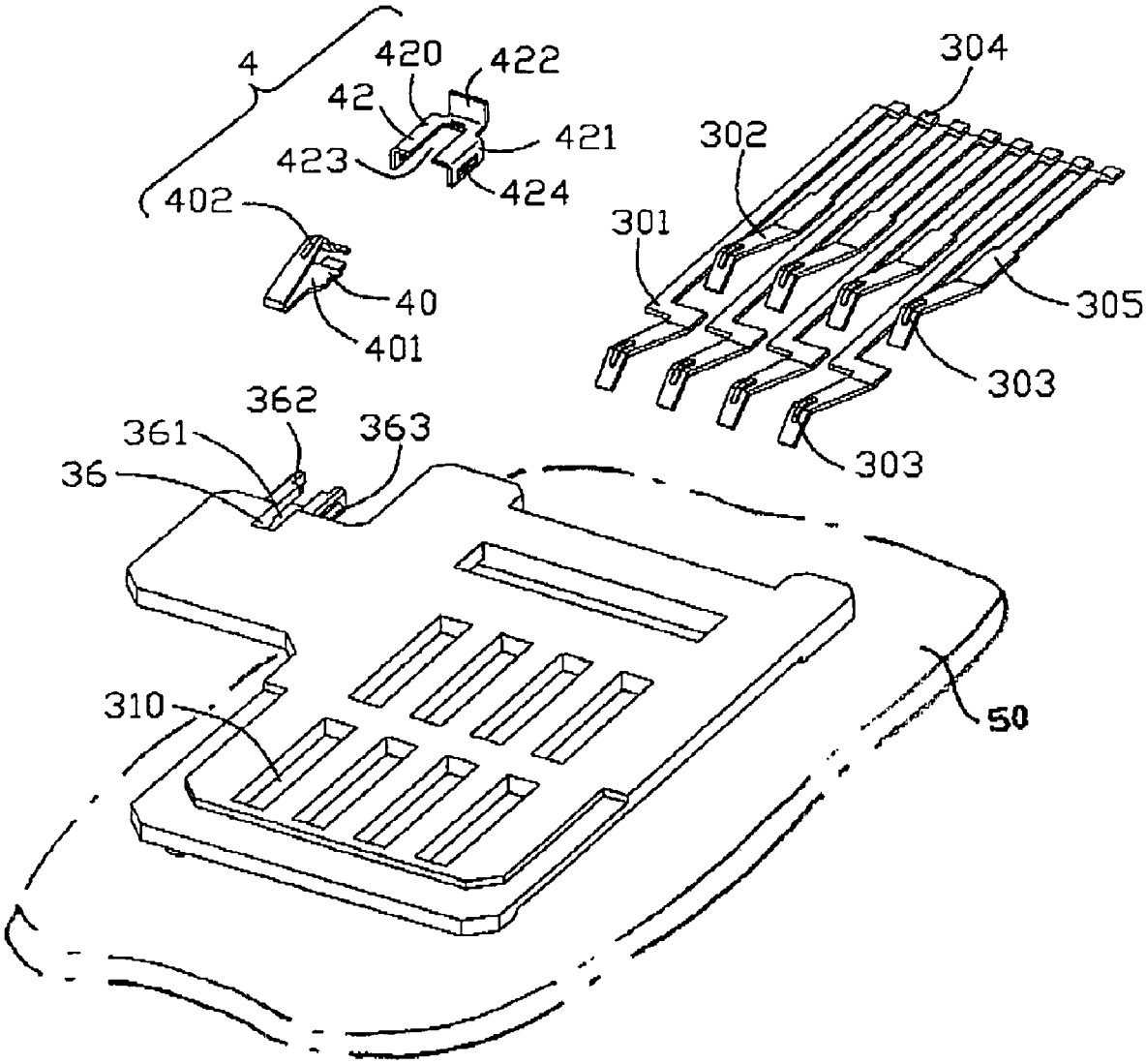
FIG. 4 is an exploded perspective view of a terminal module of the electrical card connector.

As shown in FIG. 2 to FIG. 4, the bottom surface of the terminal module 3 engages with a PCB 50 completely. The terminal module 3 comprises a base section 31, a plurality of terminals 30 received in the base section 31 and a switch set 4 located beside the base section 31.

Referring to FIG. 3 and FIG. 4, the terminal module is shown detailedly. The base section 31 comprises a plurality of openings 310, a plurality of position poles 32 (shown in FIG. 2) extending downwardly from the bottom surface of the base section 31, and a limb 33 extending horizontally and outwardly from the base section 31. The openings 310 go through the base section 31 in an up-to-down direction, and are arranged in two rows in a front-to-back direction. The climb 33 is flat and smooth for being sucked by a picking up equipment, and has a locking section 36 for fixing the switch set 4. The locking section 36 comprises a receiving channel 361 and a pair of locking arms 362 extending backwardly from the opposite sides of the receiving channel 361 beyond the limb 33. On each outside surface of the locking arms 362, a block 363 is formed.

The terminals 30 adapted for being embedded in the base section 31, include a first terminal group 301 and a second terminal group 302. Each terminal 30 comprises an engaging portion 303 for engaging electrically with a card, a soldering portion 304 for soldered on the PCB and a joining portion 305 connecting the engaging portion 303 with the soldering portion 304. Each joining portion 305 of the first terminal group 301 is longer than that of the second terminal group 302, and extends in a card insertion direction. Each engaging portion 303 of the first terminal group 301 protrudes out of the former opening 310, and each engaging portion 303 of the second terminal group 302 protrudes out of the backer opening 310. Accordingly, the soldering portions 304 extend beyond the rear end of the base section 31.

The switch set 4 comprises an active member 40 and a passive member 42. The active member 40 has a fixing section 401 resembling a lath configuration, and an elastic engaging section 402 rising slantingly from the fixing section 401. The passive member 42 has a main body 420, a pair of fixing arms 421 extending downwardly from the opposite sides of the main body 420, and a projecting portion 422 extending upwardly from the main body 420 between the fixing arms 421. The main body 420 has a hollow 423 surrounded by the fixing arms 421. Each fixing arm 421 has a setting hatch 424 connecting with the hollow 423. The passive member 42 is mounted on the locking arms 362 of the locking section 36, and the hollow 423 is placed over the receiving channel 361 rightly. The fixing arms 421 matches with the locking arms 362 by the setting hatches 424 clasping corresponding blocks 363. The fixing section 401 of the active member 40 is placed in the receiving channel 361, and the engaging section 402 protrudes out of the hollow 423 to be located at the frontage of the projecting portion 422, at the same time, the end of the engaging section 402 collides with the lower surface of the main body 420. Normally, the switch set 4 is closed. When a card is inserted, the engaging section 402 is pressed down together with the end thereof separated with the main body 420, then, the switch set 4 is open.

Going with FIG. 1 to FIG. 4, how to assemble the electrical card connector 100 is described in following segment. Firstly, the terminal module 3 is mounted on the PCB with the position poles 32 of the terminal module 3 plugged into the PCB. Certainly, the position poles 32 can be replaced by other position members. Secondly, the soldering sections 304 of the terminals 30 are soldered on the PCB achieving the terminals 30 connecting electrically with the PCB. The fasteners 25 of the shell 2 lock with corresponding recesses 16 of the insulating housing 1, and the holes 23 of the shell 2 mating with corresponding embossments 15 to establish a receiving slot 5 for a card receiving movably. Thirdly, the members formed by the shell 2 and the insulating housing 1 are assembled with the terminal module 3 placed on the PCB, allowing the terminal module 3 to retain in the accommodating room 14 properly under a condition that the terminal module 3 defines a step 35 which is receivably engaged within a recess 141 defined in an underside of the housing 1, the engaging section 303 of the terminals 30 protruding into the receiving slot 5. Finally, the position foots 24 of the shell 2 are mounted on the PCB achieving the shell 2 and the insulating housing 1 placed on the PCB.

Comparing with prior art, the insulating housing and the terminal module of the present invention match with each other in a separated way. The terminal module is pressed partially by the insulating housing. In a word, the terminal module is soldered on the PCB, then a combination formed by the shell and the insulating housing is mounted on the PCB without soldering therebetween. Therefore, the insulating housing is capable of avoiding a distortion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector mounted on a Printed Circuit Board (PCB) comprising:

an insulating housing defining an accommodating room;

a shell mounted on the insulating housing, and forming a receiving slot with the insulating housing for insertion of a card; and a terminal module comprising a plurality of terminals and a positioning section retained on the PCB;

wherein the terminal module is soldered on the PCB directly and is received in the accommodating room of the insulating housing separately and is pressed partially by the insulating housing under a condition that the terminal module defines a step which is receivably engaged within a recess formed in an underside of the housing.

2. The electrical card connector as claimed in claim 1, wherein the configuration of the terminal module accords with that of the accommodating room of the insulating housing, and the terminal module is received in the accommodating room completely.

3. The electrical card connector as claimed in claim 1, wherein the positioning section of the terminal module is a positioning pole.

4. The electrical card connector as claimed in claim 1, wherein the insulating housing comprises a plurality of recesses, and the shell comprises a plurality of fasteners matching with corresponding recesses of the insulating housing.

5. The electrical card connector as claimed in claim 1, wherein the shell comprises a positioning foot placed on the PCB directly.

6. The electrical card connector as claimed in claim 1, wherein the terminals are embedded in the terminal module.

7. The electrical card connector as claimed in claim 1, wherein the terminal module comprises a base section retaining the terminals and a limb extending from a side of the base section.

8. The electrical card connector as claimed in claim 7, wherein the limb is flat and smooth and comprises a switch set for detecting whether a card is inserted completely or not.

9. The electrical card connector as claimed in claim 1, wherein each terminal comprises an engaging portion protruding into the receiving slot for connecting with a card electrically.

10. The electrical card connector as claimed in claim 9, wherein each terminal comprises a soldering portion and a joining portion connecting the engaging portion with the soldering portion together, and the joining portion is retained in the terminal module.

11. The electrical card connector as claimed in claim 10, wherein the terminals comprise a first terminal group and a second terminal group, and each joining section of the first terminal group is longer than that of the second terminal group.

12. The electrical card connector as claimed in claim 1, wherein the terminal module comprises a bottom surface engaging with the PCB completely.

13. An electrical connector assembly for mounting to a printed circuit board, comprising:

a terminal module including an insulator equipped with a plurality of terminals under a condition that the terminal is configured to be directly soldered upon the printed circuit board;

a combination including an insulative housing and a metallic shell assembled with each other and commonly defining a horizontal card receiving cavity;

said housing being configured to be positioned upon the printed circuit board and defining an opening to compliantly receive said terminal module therein and allow contacting portions of said terminals to extend into the card receiving cavity; wherein said housing is configured to be fastened to the printed circuit board and presses on parts of the terminal module under a condition that the terminal module defines a step which is receivably engaged within a recess formed in an underside of the housing.

14. The connector assembly as claimed in claim 13, wherein said opening is dimensioned and configured not to allow the terminal module to completely pass through so that the terminal module is required to be first mounted to the printed circuit board before the housing mounted to the printed circuit board.

15. The connector assembly as claimed in claim 13, wherein said terminal module is equipped with at least on downward post for coupling to a hole in the printed circuit board.

16. The connector assembly as claimed in claim 13, wherein the insulator and the housing have no direct fastening relation with each other.

17. A method of mounting a card connector to a printed circuit board, comprising in sequence steps of:

providing a terminal module with an insulator equipped with a plurality of terminals thereon;

mounting the terminal module to the printed circuit board and soldering tails of the terminals to the printed circuit board;

providing a combination including an insulative housing and a metallic shell assembled to each other under a condition that said housing and said shell commonly define a horizontal card receiving cavity, and said housing further defines an opening;

fastening the combination to the printed circuit board under condition that the terminal module is received in the opening and contacting portions of the terminals extend into the card receiving cavity, and that the terminal module defines a step which is receivably engaged within a recess formed in an underside of the housing.

18. The method as claimed in claim 17, wherein said housing is fastened to the printed circuit board via a non-soldering process.

19. The method as claimed in claim 17, wherein the opening is dimensioned and configured not to allow the terminal module to pass therethrough completely.

* * * * *